US008689600B2

(12) United States Patent
Weigelt

(10) Patent No.: US 8,689,600 B2
(45) Date of Patent: Apr. 8, 2014

(54) WEDGE DRIVE WITH A FORCE RETURNING DEVICE

(76) Inventor: Harald Weigelt, Kürten (DE)

( * ) Notice: Subject to any disclaimer, the term of this patent is extended or adjusted under 35 U.S.C. 154(b) by 826 days.

(21) Appl. No.: 12/376,264

(22) PCT Filed: Aug. 2, 2007

(86) PCT No.: PCT/EP2007/006856
§ 371 (c)(1),
(2), (4) Date: Oct. 30, 2009

(87) PCT Pub. No.: WO2008/015000
PCT Pub. Date: Feb. 7, 2008

(65) Prior Publication Data

US 2010/0107722 A1 May 6, 2010

(30) Foreign Application Priority Data

Aug. 3, 2006 (DE) ..... 10 2006 036 654

(51) Int. Cl.
*B21J 9/18* (2006.01)
*B30B 1/26* (2006.01)

(52) U.S. Cl.
USPC ..... 72/452.9; 72/429

(58) Field of Classification Search
USPC ..... 72/452.1–452.9, 312–315, 429, 316; 29/243.57, 243.58
See application file for complete search history.

(56) References Cited

U.S. PATENT DOCUMENTS

| | | | | |
|---|---|---|---|---|
| 4,515,049 | A | | 5/1985 | Dietz et al. |
| 5,101,705 | A | | 4/1992 | Mitsuoka |
| 5,149,071 | A | | 9/1992 | Oliviera |
| 5,197,834 | A | | 3/1993 | Chase et al. |
| 5,269,167 | A | * | 12/1993 | Gerhart ..... 72/381 |
| 5,487,296 | A | * | 1/1996 | Gerhart et al. ..... 72/381 |
| 5,551,795 | A | | 9/1996 | Engibarov |
| 5,904,064 | A | | 5/1999 | Higuchi |
| 6,126,159 | A | | 10/2000 | Dornfeld |
| 6,990,844 | B1 | | 1/2006 | Fidziukiewicz |
| 7,013,783 | B2 | | 3/2006 | Matsuoka |
| 7,114,364 | B2 | | 10/2006 | Weigelt |
| 7,191,635 | B2 | | 3/2007 | Chun |

(Continued)

FOREIGN PATENT DOCUMENTS

| | | |
|---|---|---|
| DE | 19860178 C1 | 5/2000 |
| EP | 0 484 588 A1 | 5/1992 |

(Continued)

*Primary Examiner* — Dana Ross
*Assistant Examiner* — Lawrence Averick
(74) *Attorney, Agent, or Firm* — Knobbe, Martens, Olson & Bear, LLP

(57) ABSTRACT

In a wedge drive (1) with a first part (20) which can be provided with a machining tool and a second part (30), wherein the two parts (20, 30) are arranged movably relative to each other, and there is provided at least one positive-action return device which engages or can engage both parts (20, 30), and a third part (10) which is connected to the first part (20), the at least one positive-action return device is return spring-free and has at least one device for causing and/or supporting the return of the one part (20) and/or for increasing the retraction force which can be applied in the return of the one part (20) in the upward stroke movement of the third part (10).

22 Claims, 9 Drawing Sheets

(56) References Cited

U.S. PATENT DOCUMENTS

| | | | | |
|---|---|---|---|---|
| 7,431,502 | B2 * | 10/2008 | Fidziukiewicz | 384/9 |
| 2004/0025561 | A1 * | 2/2004 | Weigelt | 72/452.9 |
| 2005/0262920 | A1 * | 12/2005 | Fidziukiewicz | 72/452.9 |
| 2006/0101894 | A1 * | 5/2006 | Chun et al. | 72/452.9 |
| 2009/0078067 | A1 | 3/2009 | Weigelt | |

FOREIGN PATENT DOCUMENTS

| | | | |
|---|---|---|---|
| EP | 1035965 | B1 | 8/1998 |
| EP | 1259371 | B1 | 12/1999 |
| EP | 1197319 | B1 | 10/2000 |
| EP | 1362651 | A1 | 11/2003 |
| JP | 04-138825 | | 5/1992 |
| JP | 11-347654 | A | 12/1999 |
| JP | 2001-1046 | | 1/2001 |
| JP | 2005-246410 | A | 9/2005 |
| KR | 20-1996-0020727 | | 7/1996 |
| KR | 10-2001-0071791 | | 7/2001 |
| KR | 20-0265751 | | 2/2002 |
| WO | WO 99/28117 | | 6/1999 |
| WO | WO 00/38907 | | 12/1999 |
| WO | WO 00/02680 | | 1/2000 |
| WO | WO 02/306591 | A1 | 4/2002 |
| WO | WO 2006/036381 | A2 | 8/2005 |
| WO | WO 2006/136404 | A1 | 12/2006 |

* cited by examiner

WEDGE DRIVE WITH A FORCE RETURNING DEVICE

CROSS REFERENCE TO RELATED APPLICATIONS

This application claims the benefit and priority to and is a U.S. National Phase of PCT International Application Number PCT/EP2007/006856, filed on Aug. 2, 2007. This application claims the benefit and priority to German Application No. DE10 2006 036 654.9 filed on Aug. 3, 2006. The disclosures of the above-referenced applications are hereby expressly incorporated by reference in their entirety.

BACKGROUND OF THE INVENTION

1. Field of the Invention

The invention concerns a wedge drive or cotter key with a first part which can be provided with a machining tool and a second part, wherein the two parts are arranged movably relative to each other, and there is provided at least one positive-action return device which engages or can engage both parts, and a third part which is connected to the first part.

2. State of the Art

Wedge drives are used in particular in the automobile industry for converting a perpendicular pressing force into a horizontal movement. In particular in the production of bodywork parts, it is possible in that way to carry out shaping processes or operations for cutting or perforating bodywork parts, which is not possible by means of a perpendicular working movement, that is to say the normal direction of movement of a press. Wedge drives must therefore be so designed that they convert very high working pressures of a press into the desired working direction, that is to say for example a horizontal direction, in which case at the same time a linear guide is provided. The pressures occurring in that case can rapidly exceed 5,000 kN. In that respect, it is also possible to arrange in a press tool a plurality of and in particular ten or more such wedge drives which perform different functions and which for that purpose operate with different angles of inclination with respect to the working direction.

In a wedge drive, a linear guide is always provided in the form of the wedge drive bed which, depending on the respective design configuration involved, is intended to provide pressing pressures of more than 100 kN with a guide play of a maximum of 0.02 mm in the respectively desired direction in accurate repetition relationship.

A drive wedge, hereinafter referred to as the driver element, is intended in that case to apply the perpendicular pressing force to the actually movable wedge drive element, the wedge drive slide, referred to hereinafter as the slider element. The slider element receives the tools required for the machining operation and therefore performs the actual machining process and is reciprocated in a driven mode in the linear guide of the press. The tools which can be mounted to a slider element for cutting or shaping a workpiece such as a bodywork part can be of different designs. In that respect it is possible to mount only for example one single perforating punch or a number of perforating punches or other tools such as for example also a number of individual blades of a total length of more than a meter. The same also applies to the post-shaping area, in which case simple shaping punches or also reshaping jaws for subsequent reshaping of various portions of a workpiece which can extend over one or more meters can be used as the tools. Therefore, in order to meet those differing requirements of non-cutting shaping in a pressing tool, wedge drives of different sizes and with a different working angle are available on the market. Examples of such wedge drives are also described in WO 02/30659 A1, WO 99/28117 and EP 0 484 588 A1.

The design configuration of the wedge drive depends on the activities to be performed, that is to say for example it is dependent on the sheet metal thickness and the sheet metal quality of the workpiece to be worked, the respective working length and the nature of the machining operation, for example cutting or shaping. In accordance with the requirements of the automobile industry, it is necessary to ensure that a wedge drive must attain at least 1,000,000 strokes with the required working force and an operational play which ensures that the respective perforating punch meets a corresponding cutting bush or counterpart die in accurately targeted relationship. A displaced encounter of a perforating punch or a cutting blade has the result that increased abrasive wear can occur at the perforating punch or cutting blade and at the cutting bushes, which in the worst-case scenario leads to fracture of the cutting or shaping tool in the form of a perforating punch, cutting blade etc. A force acts on the cutting and shaping tools not only in the actual working stroke movement for penetrating or shaping a workpiece, but also in the return movement thereof. It is precisely in the case of a perforating punch which only in regard to a certain extent cuts through a workpiece in the form of a metal sheet, and only pushes through the remainder by means of a tearing movement, a clamping action can occur in the return movement, and that clamping action in the worst-case scenario can lead to damage to the workpiece and the perforating punch or cutting blade. That effect is increased by deposits of zinc or aluminum when working with zinc or aluminum sheet which nowadays is increasingly being used in the automobile industry. Those deposits on the cutting means lead to lubrication or to the formation of an obstructive lubricant film which hinders further processing of workpieces with a correspondingly damaged cutting tool. The stripping-off force which acts on the cutting tool in the form of a perforating punch, cutting blade and so forth, when it is retracted from a workpiece, is between about 5 and 12% of the actual working force.

In a wedge drive, such a stripping-off force which is also referred to as the retraction force is applied for example by means of a return spring. It will be noted however that it has been found that such springs can apply the required stripping-off force or retraction force of between 5 and 12% of the working force, only in the rarest cases, as the structural space which is only limitedly available in a wedge drive means that it is possible to use only very small and thus weak springs. The wish on the part of the automobile industry to nonetheless maintain those values cannot be met with the spring systems available on the market such as for example coil springs, rubber or plastic springs, gas pressure springs and so forth, in particular by virtue of the small structural space available within the wedge drives. By way of example, in the case of a wedge drive involving a working force of 5,000 kN, a stripping-off or retraction force of 600 kN or more would have to be maintained, but the available spring systems only make it possible to maintain values of not even 300 kN. The result of this is that extensive and costly special solutions have to be used to maintain the required values. A further disadvantage of springs is in particular also that, with an increasing loading, they lose in terms of service life. The required values of 1,000,000 strokes cannot therefore be even approximately achieved without expensive replacement of the spring systems being required. As a result operation of a wedge drive is not only additionally increased in cost but it also leads to process uncertainty as the failure or the at least restricted operation of such a spring system cannot be estimated in advance. A failure of one such return spring has the result that the wedge drive no longer slides back into its end position and thus the machined workpiece is no longer freed for removal. That results in considerable losses and thus immense additional costs which however obviously have to be avoided. The requirement therefore is admittedly to make the retraction forces on the one hand as high as possible, while however at the same time increasing the service lives of such a wedge drive and designing with a greater degree of process certainty.

To achieve this, clamp-like positive-action return devices are known, as are used for example in the above-mentioned publications in the state of the art. Those clamp-like positive-action return devices are mounted in positively locking relationship to the wedge drive and hold the slider element and the driver element together in such a way that retraction into the end position takes place in reproducible fashion. The positive-action return devices in the state of the art however are not designed for permanent ongoing operation but only serve to release a brief sticking effect. It has further been found that operation with a particularly long manufacturing interval is also not possible with such positive-action return devices in the state of the art, in which respect one problem is that an overloaded positive-action return device breaks off and causes even greater damage, in the form of a foreign body, in the wedge drive or the press, than a wedge drive which unintentionally sticks because of a yielding spring.

SUMMARY OF THE INVENTION

Therefore the object of the present invention is to develop a wedge drive as set forth in the classifying portion of claim 1 in such a way that there is provided an improved positive-action return device which withstands the required loading level of 1,000,000 strokes and in so doing reproducibly permits the wedge drive to be retracted into its end position and in particular the positive-action return device can apply a retraction force of 12% and more of the actual working force, but at the same time does not entail any particular increase in costs in comparison with the existing solutions involving a spring system or the known clamp-like positive-action return devices as are described for example in WO 02/30659 A1, WO 99/28117 or EP 0 484 588 A1.

That object is attained by a wedge drive as set forth in the classifying portion of claim 1, in that the at least one positive-action return device is return spring-free and has at least one device for causing and/or supporting the return of the one part and/or for increasing the retraction force which can be applied in the return of the one part in the upward stroke movement of the third part. Further developments of the invention are defined in the appendant claims.

In that way there can be provided a wedge drive in which the retraction force is applied by a different device from a return spring. By way of example a gas pressure spring which is otherwise used in the state of the art for retraction of the slider element is then entirely eliminated. Gas pressure springs of that kind have a tendency, in the event of prolonged actuation, to become hot and then possibly fail. In the event of a failure, they lead, in the state of the art, to jamming of the wedge drive. If such a gas pressure spring is omitted in the present invention as a positive-action return effect is already effected or assisted by way of the at least one other device, it is possible to achieve a great advantage over the state of the art by virtue of the increased process certainty in consideration of the gas pressure spring no longer being used. The device according to the invention is advantageously so designed that it minimizes the retraction forces which can be applied in the return movement so that a return movement of the one part of the wedge drive is easily possible even without a return spring. In that respect the device for causing and/or supporting the return movement and/or increasing the retraction force which can be applied advantageously has a connection, based on rolling friction, between the two parts. The forces which can be applied in the case of a connection based on rolling friction are low so that the required forces for retraction of the one part of the wedge drive can be reduced in relation to the solutions in the state of the art in which the above-mentioned clamp connections and gas pressure springs are used.

Advantageously the at least one positive-action return device includes at least one roller or a roller-like element for rolling on a surface of the one part of the wedge drive for supporting the return movement of the one part and/or for increasing the retraction force which can be applied in the return movement of the one part. That therefore provides a wedge drive in which, unlike the state of the art, use is made of a rolling friction employing rolling bodies, which is very much less than a sliding friction over sliding surfaces. Accordingly the force to be applied in the return movement is reduced. In the state of the art, a positive-action return device in the form of a steel clamp or bar is fixed laterally to the wedge slide or slider element and hooks behind a sliding surface on the driver element, the sliding surface extending parallel to the driver surface. When the parts move away from each other, when the positive-action return device is subjected to the action of force, in the state of the art the result of this is that the surfaces, which slide against each other, of the driver element and the positive-action return device are held against each other until at the end there is only still a linear contact between them and subsequently the driver element and the positive-action return device slide away from each other. Shortly before they separate or slide away from each other, those surfaces which slide against each other, or that end region on the driver element, is subjected to a particularly high level of abrasive wear although the state of the art also provides that there is a rounding here on the sliding surface on the driver element.

Now, in accordance with the invention, the sliding surface provided on the positive-action return device for sliding against the sliding surface of the driver element is replaced by a roller or a roller-like element or is supplemented by a roller or a roller-like element. The provision of the roller or the roller-like element means that no scraping or abrading of sliding surfaces against each other occurs, precisely in the end region of the sliding surface on the driver element. Rather, the arrangement provides that it is over the entire length of the sliding surface on the driver element, over which the roller or the roller-like element passes, that a uniform movement thereof is made possible. By virtue of using a roller, it can be used for a lower level of rolling friction in comparison with the sliding friction involved in the positive-action return devices in the state of the art. The surface pressure in the end region of the sliding surface on the driver element, between the surfaces which slide against each other of the positive-action return device and the driver element advantageously no longer occurs in that region, with the provision of a roller or a roller-like element. Depending on the respective nature of the diameter or the roller-like element, the same linear contact and thus force transmission occurs in each portion of the surface of the driver element, against which the roller or the roller-like element rolls. There is therefore no longer any fear of the end region of the surface on the driver element, over which the roller rolls, breaking off.

In the upward stroke movement of the press, the positive-action return device having at least one roller or roller-like element makes use of the otherwise unused force of the press for returning the slider element as the first part over the driver element slope or inclined face, and the positively locking embracing clamping engagement of the corresponding surface on the driver element as the second part over the roller or the roller-like element. In that way it is possible to meet the minimum requirement of a retraction force of at least 12% of the working force. In addition, positive control of the wedge drive is effected by way of the press movement, in which case the wedge drive in the working direction and the retraction direction respectively uses the press forces and it is thus possible to achieve a multiple of the retraction force which can be built up by a spring. By virtue of the very slight wear due to the provision of the rolling friction, it is possible to provide a maintenance-free and long-life structure which permits ongoing use of the press forces which are in any case available within the press. The present invention also affords a major advantage over the state of the art, in relation to operating costs. The operating costs can be reduced by more than 20% and the manufacturing costs for such a wedge drive can be reduced by more than 30% due to the elimination of expensive spring systems. A further reduction in costs can be achieved by the maintenance of the wedge drive, which is scarcely any longer required. Furthermore, with the elimination of the spring system, there is no longer the risk of an accident when dismantling parts which are subjected to a spring force so that the operation of wedge drives designed in accordance with the invention can also be handled more easily and more safely. That therefore affords not only an enormous economic advantage but also an advantage which is relevant in terms of safety, in comparison with the wedge drives in the state of the art.

Advantageously the positive-action return device is of a clamp-like configuration and is arranged on the outside of the wedge drive. The positive-action return device can have at least one first portion engaging a slider element as a workpiece-carrying part and at least one second portion provided with the roller or roller-like element and engaging a surface of a driver element as the second part of the wedge drive.

Preferably the positive-action return device is fixed with its first portion to the slider element and engages the driver element in force-locking relationship with its second portion which is provided with the at least roller or the at least one roller-like element. By virtue of the arrangement of the positive-action return device in the form of a clamp-like element on the outside of the wedge drive, easy assembly and possibly if required also dismantling is possible, for example to replace a roller or a roller-like element which is worn after several millions of stroke movements. Fixing the positive-action return device to the slider element at one side makes it possible to provide for a precisely defined position thereon and in comparison with the driver element so as to permit positively locking or force-locking embracing engagement in respect of the surface provided for that purpose on the driver element.

Advantageously the roller or the roller-like element is arranged asymmetrically on the positive-action return device, in particular the second portion thereof. Preferably the roller or the roller-like element is arranged displaced in the direction towards the working direction of the slider element with respect to a central line of the positive-action return device. In that way it is possible to particularly well compensate or allow a tilting movement of the slider element in the retraction movement, without the risk of the wedge drive jamming.

The sliding play which is required in the region between the driver element and the positive-action return device for the wedge drive to function in a certain and reliable fashion should be no greater than 0.02 mm. As a wedge drive involves fitting together a large number of individual parts, the production tolerances of which, when taken together, in each wedge drive lead to different dimensions and thus result in a different sliding play, post-working is required in order to be able to maintain the tight tolerance range for the sliding play. A remedy can be afforded by subsequently matching the individual parts by grinding in or lapping the sliding surfaces. The high level of manual and individual machining complication and expenditure which occurs in that situation would give rise to a highly cost-intensive solution. For that reason at the present time the close tolerances are dispensed with, in order to avoid the high cost expenditure in manufacture. It will be noted however that the consequence of this is that purely optically a safety aspect can admittedly be suggested by virtue of the provision of a positive-action return device, but in actual fact that does not occur as, by virtue of the high production tolerances, this arrangement cannot provide a positive-action return device which functions in a reliable and certain fashion.

The aim and purpose of a positive-action return device is to cause a slider element, by means of positively-locking engagement by the positive-action return device, to move back into its rearward position before lifting off the driver element. That however is found to be appropriate only when in that respect the gap (cutting clearance), which is in the hundredths of a millimeter range, between a cutting blade or perforating punch which is fixed to the slider element, in relation to its counterpart die into which it engages, is not removed. If that gap were removed in a rearward movement of the slider element, that would lead to destruction or at least additional wear of the cutting blade or perforating punch as the cutting blade or perforating punch touches, rubs against or hits the counterpart die during the rearward stroke movement of the slider element. It is therefore desirable for the positive-action retraction movement to be such that such contact no longer occurs and the cutting means or perforating punch reach a predetermined or predeterminable required service life.

In accordance with the invention that is achieved in that there is provided at least one device for adjustment of the positive-action return device for tolerance compensation. That makes it possible to provide for adjustment of the positive-action return device so that it is possible to dispense with a burdensome and expensive operation of post-working the sliding surfaces by grinding them in or by lapping them in. That makes it possible to provide a required sliding clearance of 0.02 mm and less, in a simple fashion.

Advantageously, the adjusting device includes a movable, in particular displaceable transverse wedge. That movement or displacement makes it possible to adjust the sliding clearance to the desired 0.02 mm and less, that is to say it provides for the desired tolerance compensation.

It is precisely in connection with a sliding clearance of 0.02 mm and less that the force can be carried in an operationally certain and reliable fashion in the rearwardly directed movement of the slider element. In that way it is also possible to produce an optimum retraction force of about 10% of the actual working force of the slider element.

The combination of a rolling movement in the situation involving moving over the sliding surfaces on the driver element by the positive-action return device is found to be particularly advantageous, in order to minimize wear when traversing the trailing clamping configuration of the slider element and the driver element. In combination with the transverse wedge as the device for adjusting the positive-action return device, that affords a positive-action return device of optimum effectiveness.

Desirably the positive-action retraction force of the positive-action return device is so selected that it constitutes about 10% of the forwardly directed pressing force of the slider element. That corresponds approximately to the force required to pull a cutting means, in particular a cutting blade or a perforating punch, out of a workpiece, that is to say for stripping the cutting means off the workpiece such as a sheet metal part, having regard to possible deposits of zinc or aluminum etc. in the cutting gap.

It has further proven to be advantageous for the transverse wedge to be arranged between the first portion of the positive-action return device, that engages the slider element, and the slider element, as here it is possible to provide a fixing to the slider element. The arrangement is thus advantageously implemented between a shoulder of the positive-action return device, that engages the slider element in positively locking relationship, and a corresponding groove or recess in the slider element, into which the shoulder engages.

Advantageously the transverse wedge or the adjusting device is or can be fixed to the slider element. To permit adjustment, there can be provided in particular a slot, by way of which the adjusting device or the transverse wedge can be fixed to the slider element. Transverse displacement of the transverse wedge or the device provides that the positive-action retraction effect or the positive-action return device, after assembly of the slider element, can be easily adapted to the respective manufacturing dimension of the surface of the driver element as it engages the positive-action return device. Subsequently the positive-action return device is only still secured or fixed in the set position. It will be seen that in that way it is possible to achieve a considerable cost saving in comparison with the complicated post-working operation required in the state of the art. In addition that makes it possible to involve an operationally certain and reliable configuration in respect of the overall arrangement of the wedge drive and in particular the connection of its components of the slider element and the driver element.

It has further proven to be particularly advantageous if the at least one surface on the driver element has a rounded end region, over which the roller or the roller-like element can roll away without any problem in order to pass out of or into engagement with the surface of the driver element.

It has proven further to be advantageous if the at least one roller or the at least one roller-like element is of a diameter corresponding at least to double the radius of the rounded end region or a larger diameter than would correspond to half the width of the positive-action return device. Particularly preferably the roller or the roller-like element projects with its peripheral extent beyond the outer edge of the positive-action return device. By virtue of the provision of such a large roller, that permits on the one hand a particularly reliable and good line contact on the surface of the driver element for the roller or the roller-like element. On the other hand that permits a large force to be absorbed as the roller is sufficiently stable to carry or absorb even high pressing forces. Tilt-free rolling over the surface of the driver element can also be ensured, which results in avoiding the risk of jamming of the wedge drive even without or precisely without the provision of a gas pressure spring or another spring system.

It has proven to be further advantageous to provide at least one device for sliding guidance for carrying relatively high forces. In that case the actual retraction travel is not provided exclusively by way of the at least one roller or the at least one roller-like element, but a combination with a sliding guide means is provided for carrying relatively high forces. The at least one roller or the at least one roller-like element then serve in particular for minimizing wear when passing over the rounded end region as the entry or exit radius so that it is possible to achieve an even longer service life for the positive-action return device. The actual force in the advanced condition of the slider element of the wedge drive or the press, that is to say in the working position or in the lower dead center point of the press, can be carried primarily by way of the sliding guide means and not by way of the at least one roller or the at least one roller-like element, in which case the force which can be applied can also be markedly increased in relation to the provision of only the at least one roller or the at least one roller-like element, in which case they afford their particular advantage in respect of the retraction movement.

BRIEF DESCRIPTION OF THE DRAWINGS

An embodiment by way of the example is described in greater detail hereinafter with reference to the drawings to describe the invention more fully. In the drawings.

DETAILED DESCRIPTION OF A PREFERRED EMBODIMENT

Figure 1:
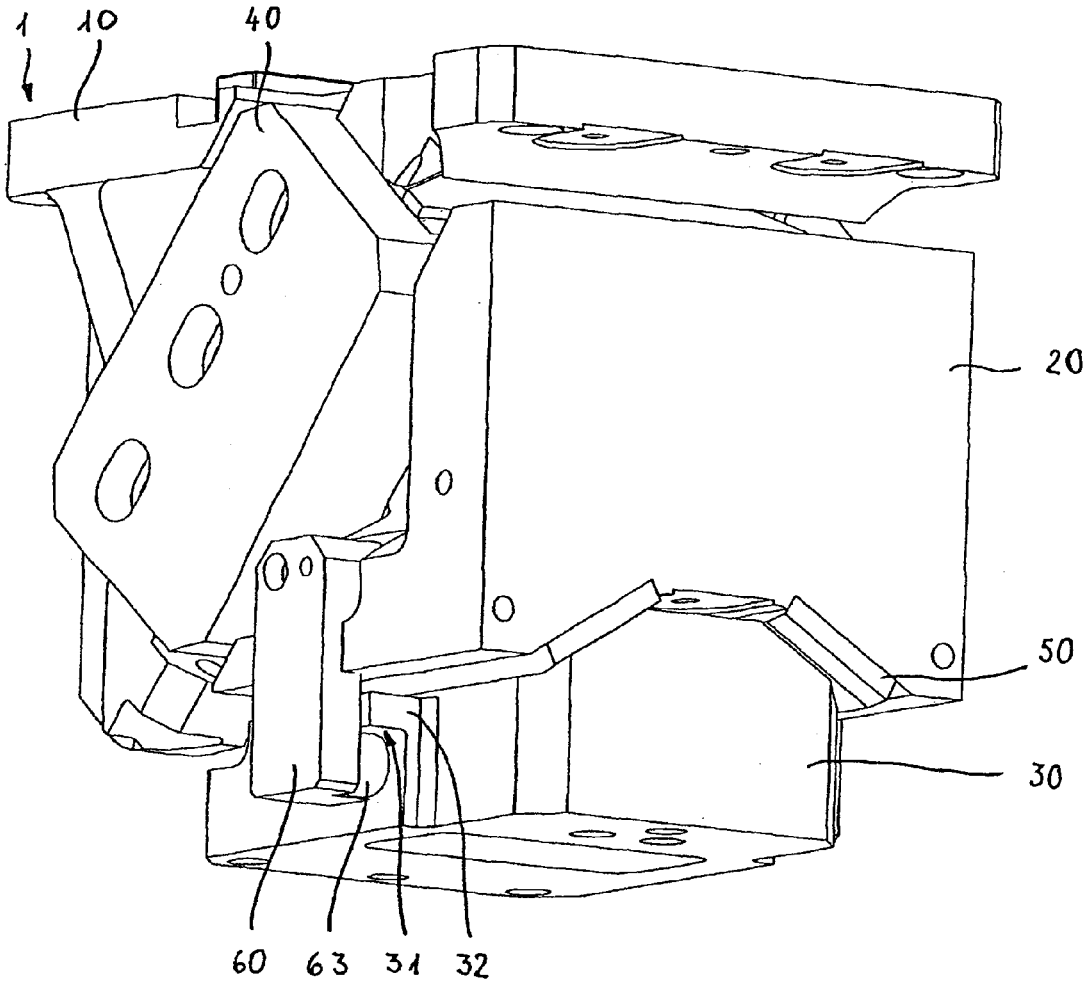
FIG. 1 shows a perspective view of an embodiment of a wedge drive with a positive-action return device according to the invention.

FIG. 1 shows a perspective view of an embodiment of a wedge drive 1 comprising a slider guide element 10, a slider element 20 and a driver element 30. The slider guide element 10 and the slider element 20 are connected together by way of two guide clamps 40. That structure corresponds to the structure described in WO 02/30659 A1. The guide clamps are respectively connected to the slider guide element and the slider element by way of holding projections 41, 42 engaging into corresponding grooves in the slider guide element and the slider element. The guide clamps are further connected to the slider guide element by way of screws 43 which are only indicated, as can be better seen from FIG. 2. The provision of the guide clamps means that the slider element and the slider guide element can be particularly well held together, in which case a required running clearance or play can be ensured even when the temperature of the wedge drive rises as the guide clamps can accommodate not only manufacturing tolerances but also material expansion phenomena which occur.

Figure 2:
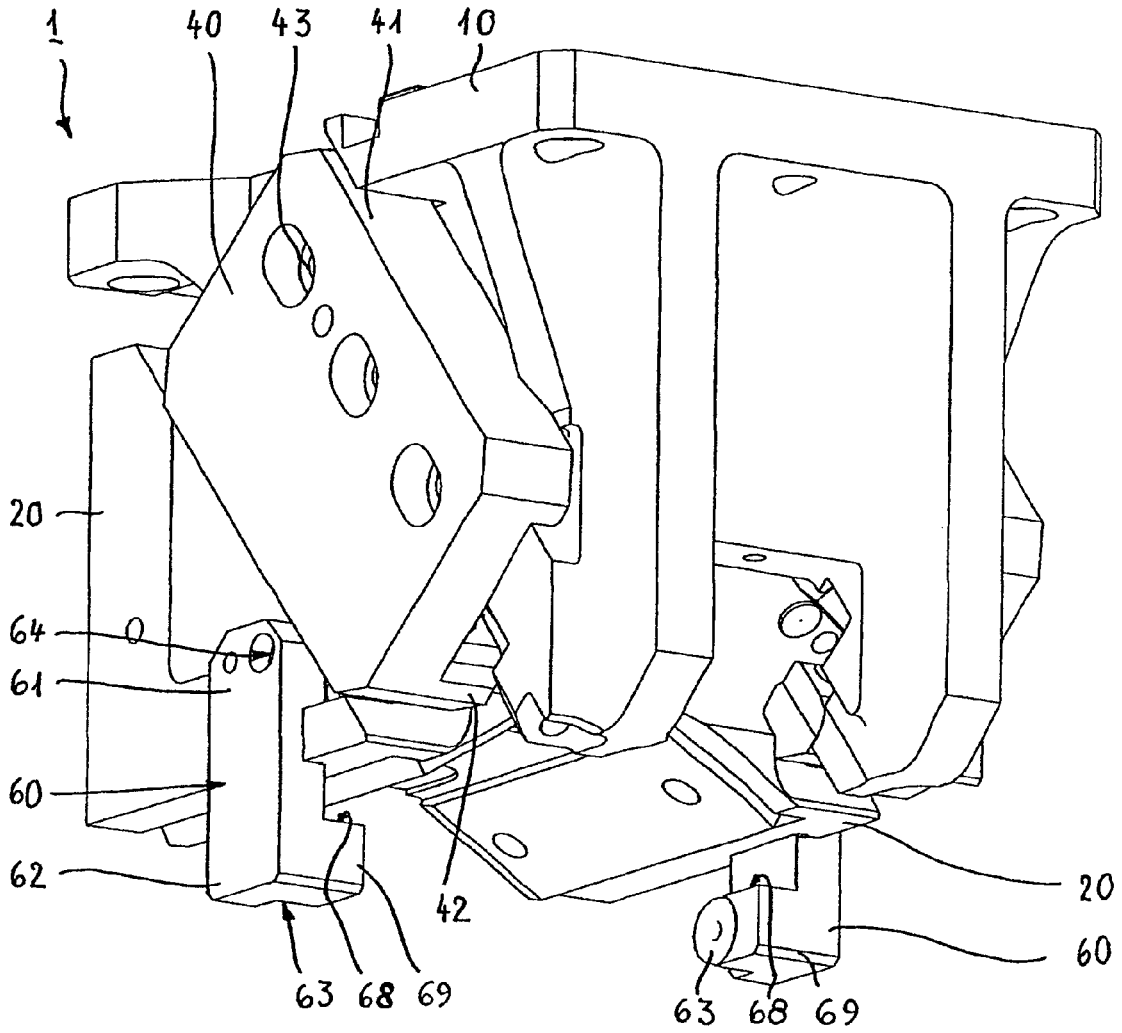
FIG. 2 shows a perspective view of the wedge drive of FIG. 1 in the position turned through 180°, without a driver element.

The slider element 20 is carried displaceably by way of a prismatic guide 50 on the driver element 30. In addition the slider element and the driver element are connected together by way of two positive-action return devices 60. The respective positive-action return device 60 which can be better seen from the perspective view in FIG. 2 is of a clamp-like structure. It has in each case a first portion 61 engaging the slider element 20 and a second portion 62 provided with a respective roller 63. The roller is mounted rotatably by way of a spindle (not shown) to the second portion 62 of the positive-action return device.

With the roller 63, the positive-action return device 60 engages an outside surface 31 of the driver element 30. That can be particularly clearly seen from FIGS. 1 and 3. Provided on the outside of the driver element in that region is a step-shaped cantilever projection 32 which on its underside has the outside surface 31 for engagement of the roller 63. By virtue of the roller engaging under the step-shaped cantilever projection 32 and the fixing of the positive-action return device 60 in the region of the first portion 61 to the slider element, secure embracing clamping is possible here for transmission of the force (force-locking connection) which is exerted by the press or the movement thereof.

Besides the roller 63 a sliding surface 68 is provided on the respective positive-action return device 60, on a protruding portion 69. The combination of the roller with the sliding surface makes it possible to carry a higher level of force.

The positive-action return device 60 is fixed to the slider element 20 by way of screws 64, as indicated in FIGS. 2 and 3 and FIGS. 5 and 6. The screws engage into openings 21, 22 laterally in the slider element 20. That can be particularly clearly seen from FIG. 4. In FIG. 4, the positive-action return devices 60 have not yet been mounted so that the step-shaped cantilever projection 32 with the outside surface 31 on the driver element 30 can also be particularly clearly seen.

Figure 3:
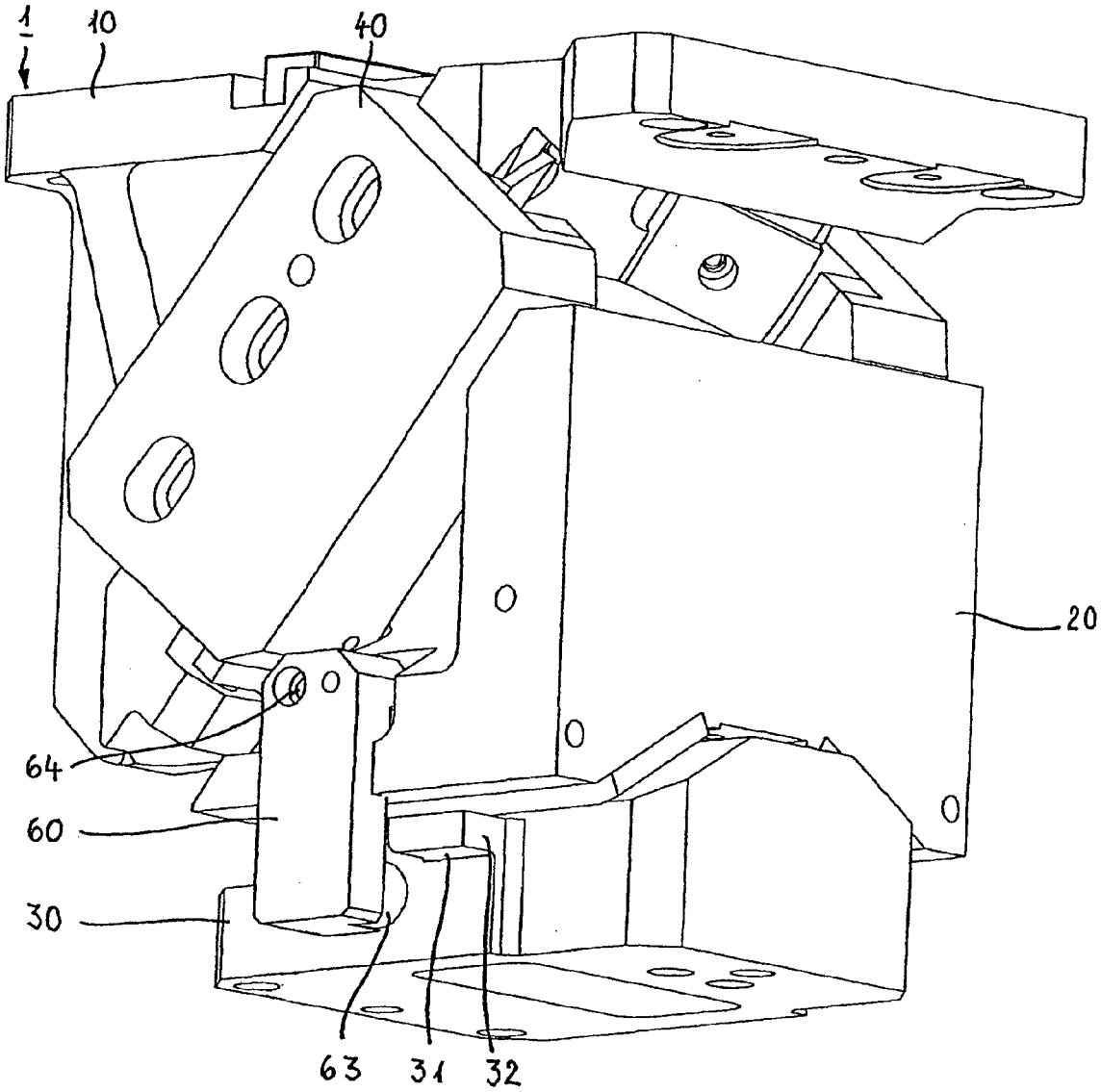
FIG. 3 shows a perspective view of the wedge drive of FIG. 1 with the positive-action return device in a position of being further retracted in relation to the position in FIG. 1.
Figure 4:
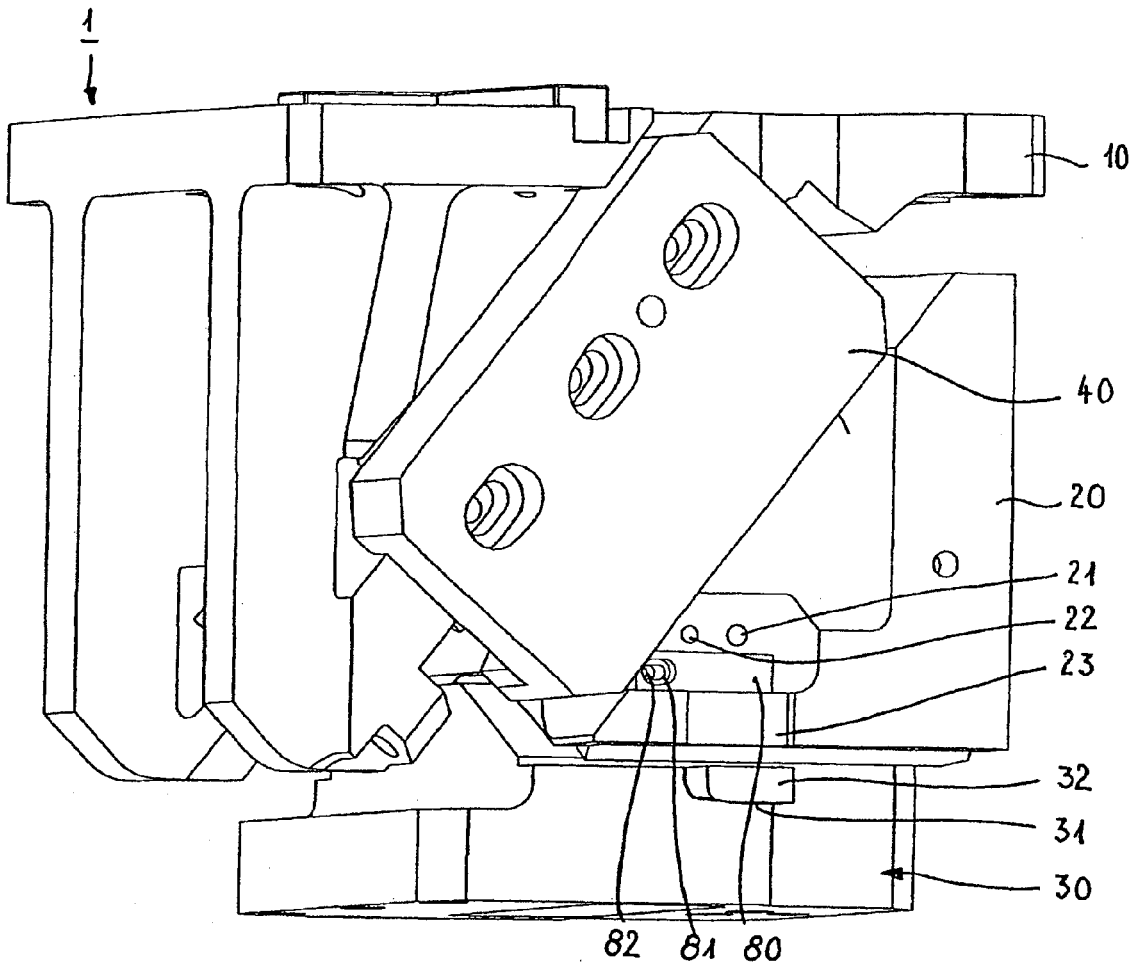
FIG. 4 shows a perspective view of the wedge drive of FIG. 1 in a position turned through 90°, without a positive-action return device.
Figure 5:
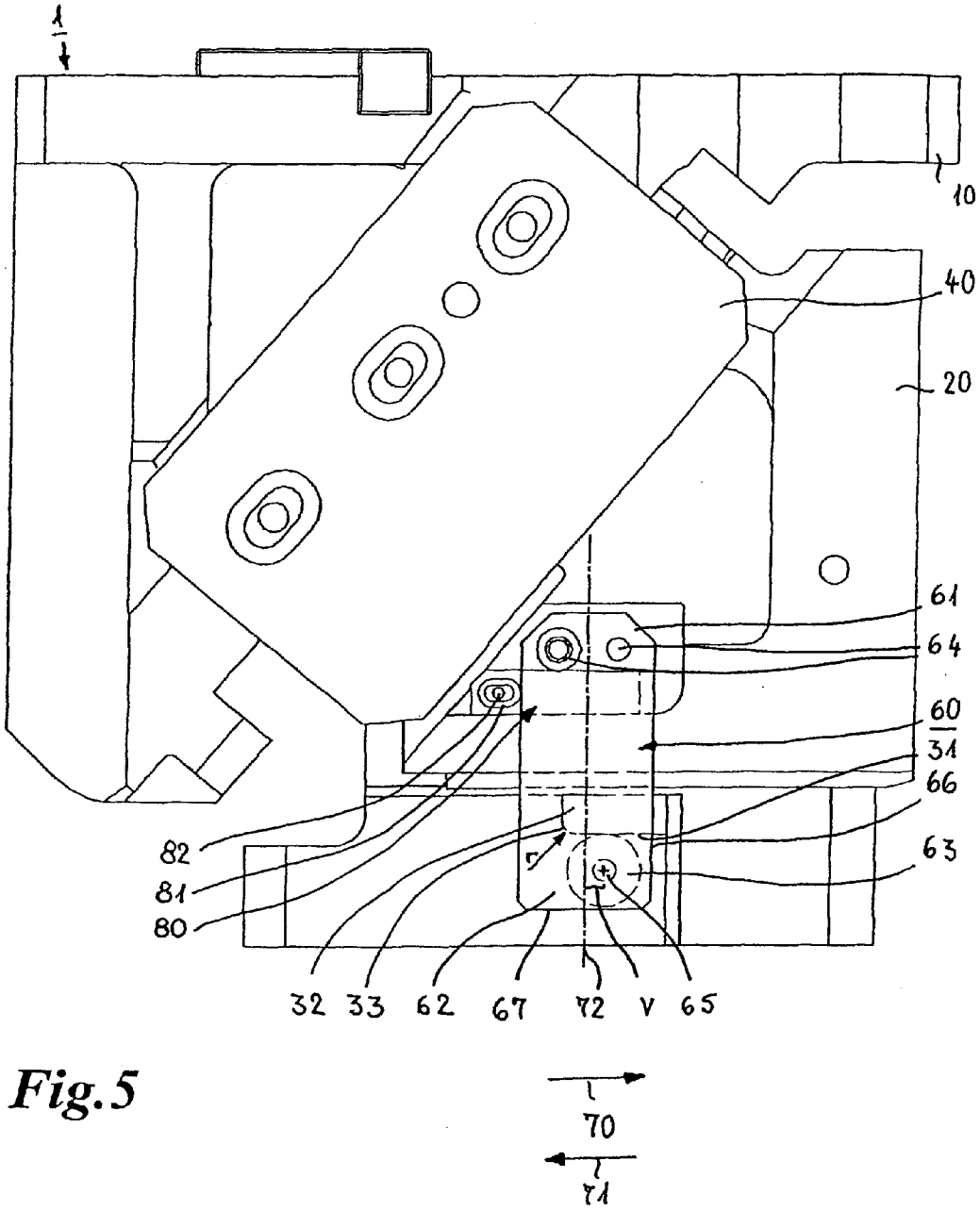
FIG. 5 shows a lateral plan view of the wedge drive of FIG. 1 in a not yet retracted working position of the slider element.
Figure 5A:
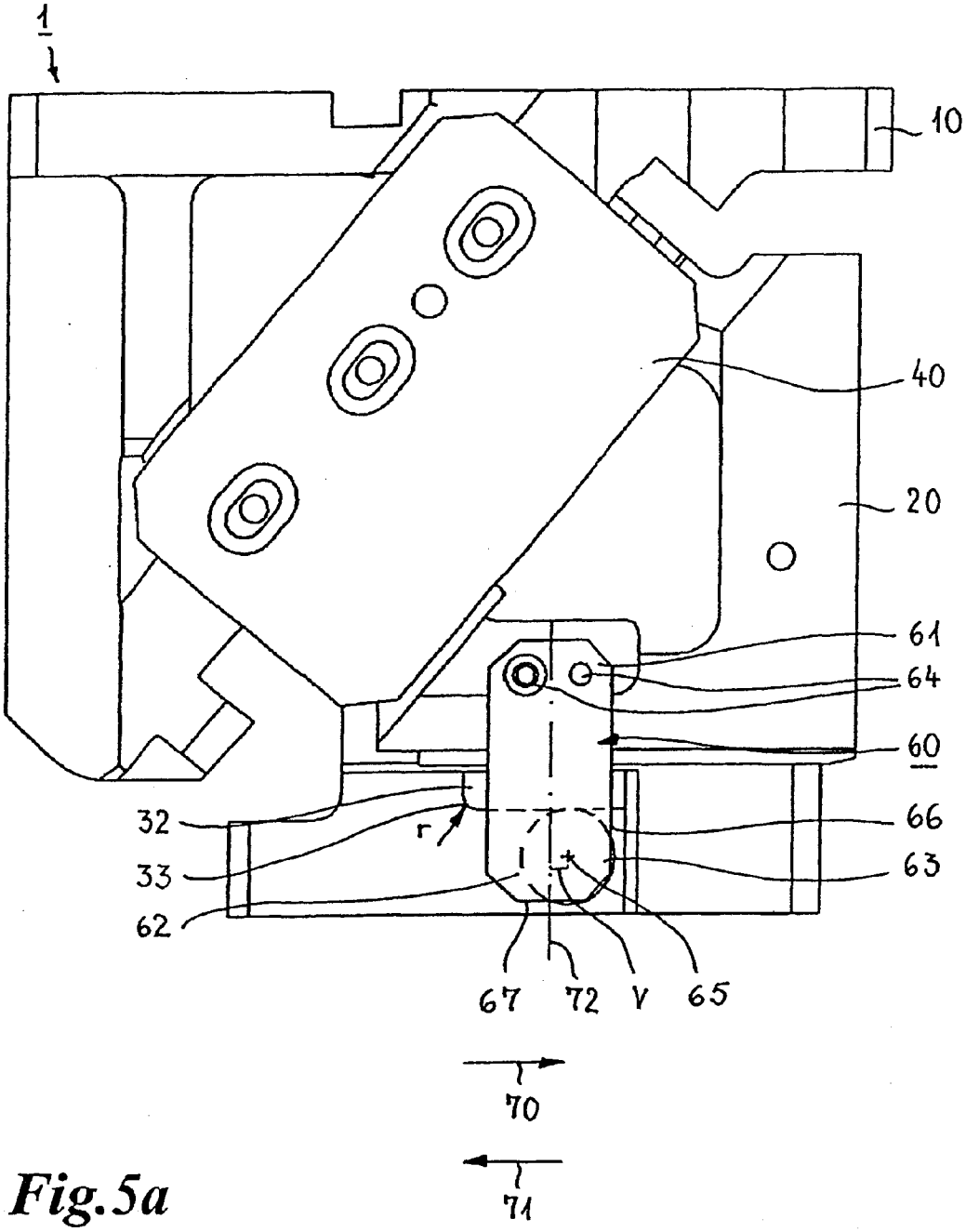
Figure 6:
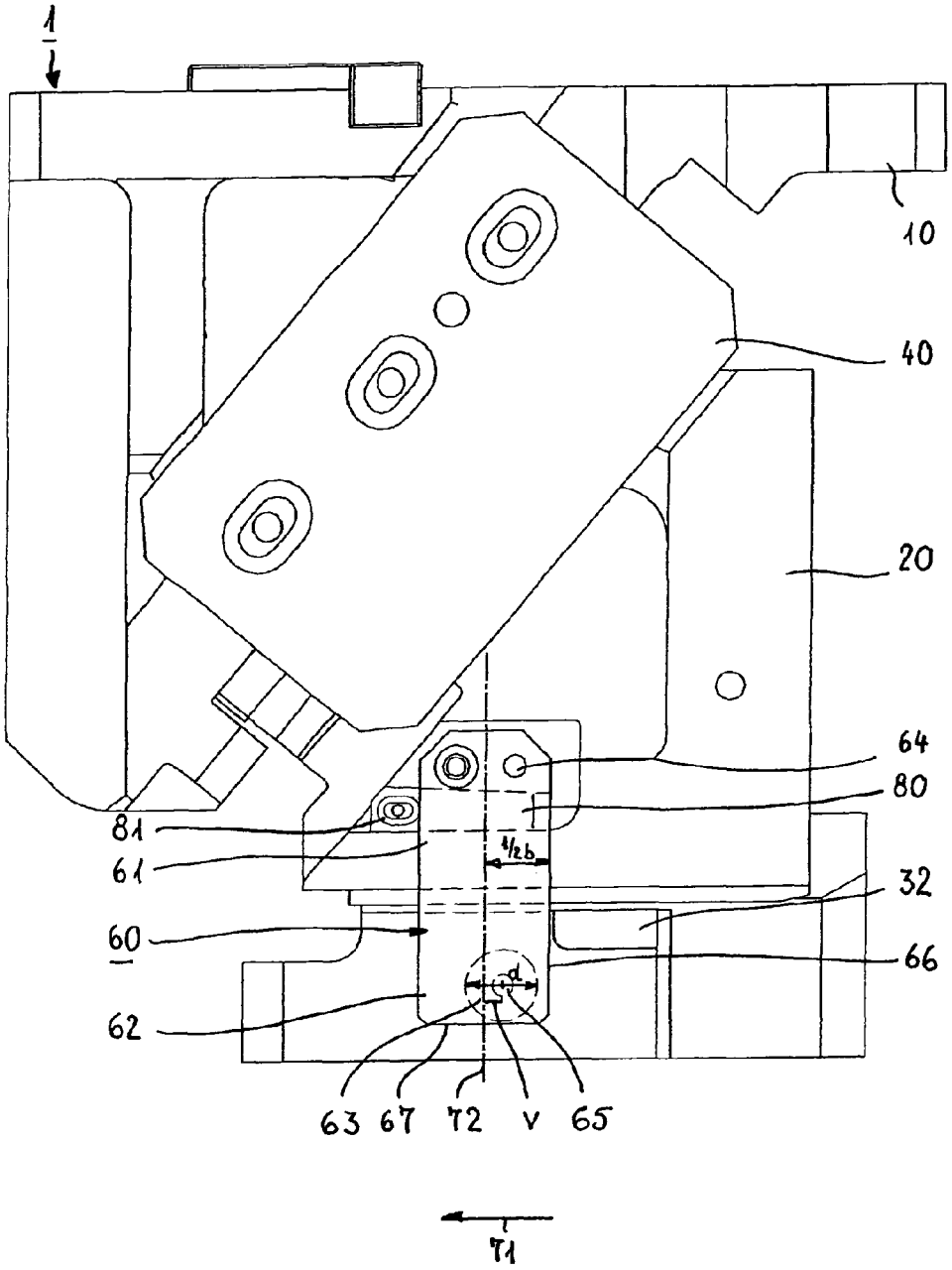
FIG. 6 shows a lateral plan view of the wedge drive of FIG. 1 in an almost completely retracted position of the slider element.
Figure 7:
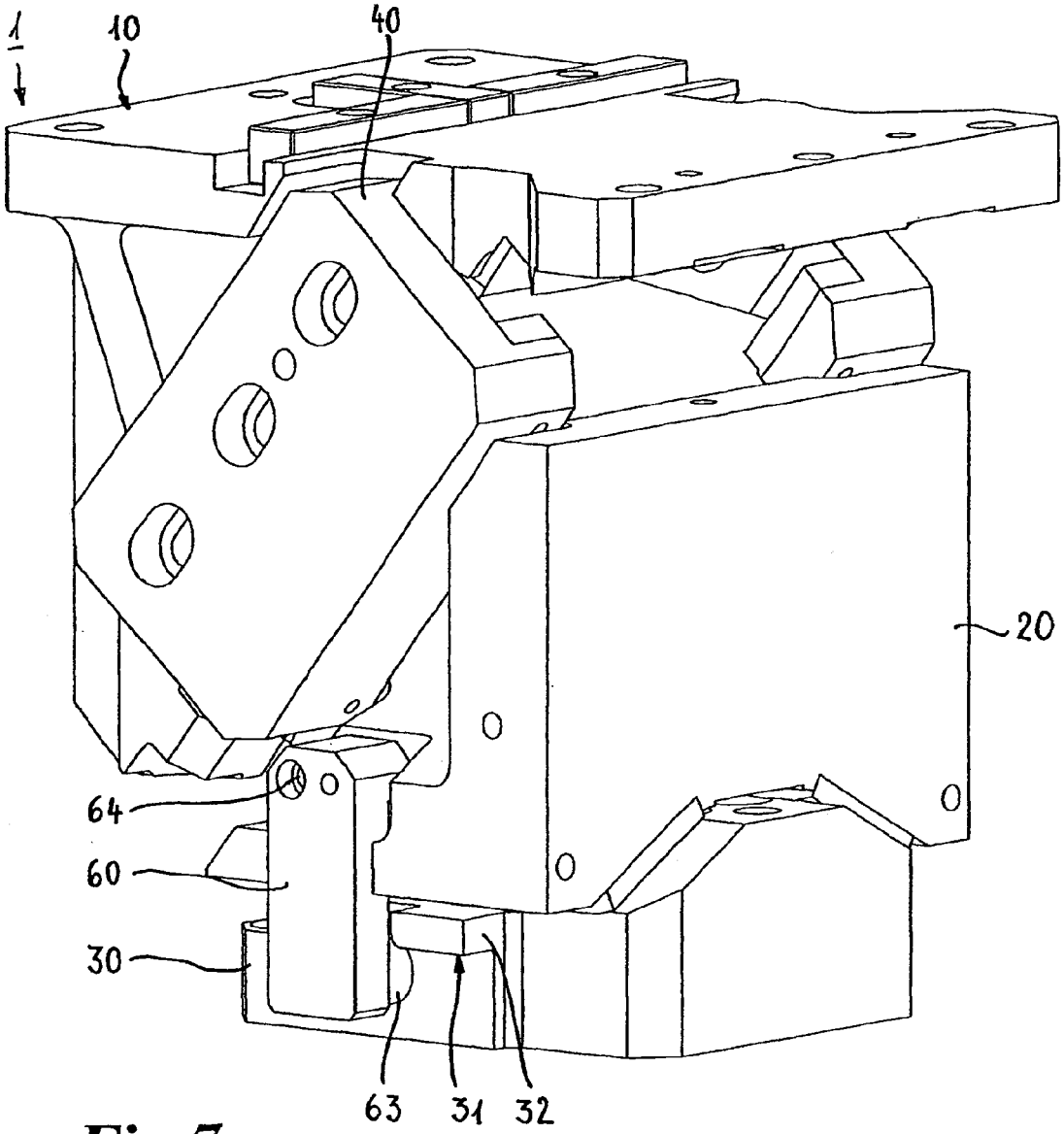
FIG. 7 shows a further perspective view of the wedge drive corresponding to FIG. 3.

As can be seen in particular from the lateral plan views in FIGS. 5 and 6 but also FIGS. 1 and 3, the roller 63 of the respective positive-action return device 60 runs along the step-shaped cantilever projection 32 and thus the outside surface 31 thereof during the working operation and the retraction movement of the press and therewith also the wedge drive. FIGS. 1 and 5 respectively show the position in which working of a workpiece (not shown) is effected, for example a perforating punch mounted to the slider element penetrates a workpiece in metal sheet form. In order subsequently to be able to pull the perforating punch out of the stamped hole again, the press movement in the upward direction is additionally used, in which case the positive-action return devices 60 run along the outside surface 31 of the step-shaped cantilever projection 32 from right to left in the drawing, that is to say in opposite relationship to the working direction 70 indicated by an arrow. A further arrow identifies that retraction direction 71. They are shown in FIGS. 3 and 6. In that respect it can be clearly seen that the positive-action return device was moved along the outside surface 31 of the step-shaped cantilever projection 32 in the retraction direction 71. In that case the roller 63 rolls against the outside surface 31 of the driver element. In order to compensate for and at the same time as far as possible prevent tilting of the slider element with respect to the driver element, the roller 63, as can be seen in particular from FIGS. 5 and 6, is arranged displaced in relation to a notional center line 72 of the clamp-shaped positive-action return device 60. The displacement V between the arrangement of the spindle 65 of the roller 63 and the center line 72 can be particularly clearly seen in particular from FIGS. 5 and 6. It can be seen from FIG. 5*a* that the roller is of a diameter which is larger than half the width b of the positive-action return device in the region of the second portion 62. In FIG. 5 in contrast the diameter of the roller approximately corresponds to half the width b of the positive-action return device. In the embodiment of FIG. 5*a* the roller 63 projects beyond the outer edges 66, 67 of the second portion 62 of the positive-action return device 60, as can be seen in particular from FIGS. 5 and 6. Because the roller 63 is as large as possible, that affords particularly good stability for the positive-action return device. In the embodiment of FIG. 5, besides the roller 63, the arrangement has the sliding surface 68 which also enhances stability. The greater the stability of the positive-action return device, then it will be appreciated that high forces of the press can be better carried and withstood. With a suitable design configuration of the positive-action return device, it is possible to dispense with a spring return means which is otherwise provided, as the upward stroke movement of the press can be used for retraction of the slider element, solely by virtue of the rollers 63 of the positive-action return devices 60 rolling against both sides of the driver element and the slider element.

As the provision of a particularly large roller 63 means that not only can the forces which occur be particularly well carried and withstood, but also the rolling friction is very much less than when surfaces slide against each other, as is provided in the state of the art, while it is also possible to achieve a retraction force of 10% or even more than 12% of the working force or maximum pressing force of the wedge drive, by means of the positive-action return devices 60.

As can be seen in particular from FIGS. 5 and 6 the step-shaped cantilever projections 32 have a rounded end region 33. Unlike the state of the art, for example in WO 02/30659 A1, here no sliding surface scrapes over that rounded end region of the step-shaped cantilever projection, but the roller 63 rolls properly thereagainst, as can be deduced from FIG. 6. Therein the roller is disposed in front of the rounded end region 33 and can subsequently roll thereon without wearing or destroying it so that the problem in the state of the art of a high level of wear in that region can be solved. The roller 63 can also pass over the rounded end region 33 onto the outside surface 31 of the step-shaped cantilever projection 32 of the driver element 30 again without any problem, as can be readily seen, so that, with the provision of the positive-action return devices 60, the arrangement provides a substantially maintenance-free long-life positive-action return device which uses the press movement which occurs in any case for positive retraction of the slider element after machining or working of the workpiece has been effected. The radius r of the rounded end region is so selected that the roller can roll thereagainst in the optimum fashion.

With the provision of a sliding surface 68 in addition to the roller 63 the roller can serve to minimize wear when passing over the entry and exit radius r so that it is possible to achieve a longer service life for the positive-action return device. In the working position, that is to say the advanced position in FIGS. 1 and 5, a large part of the force can be transmitted by way of the sliding surface and not by way of the roller, which leads to a marked increase in the force which can be applied, in comparison with the provision of only a roller 63.

In the embodiment illustrated in the Figures the positive-action return device 60 is fixed to the slider element and mounted rollably to the driver element. Basically it is also possible to provide a different arrangement of the positive-action return devices, as will be appreciated in particular also in relation to a different design configuration for the wedge drive with the slider element and the driver element itself. It will be noted however that the positive-action return device is advantageously fixed to the moving part of the wedge drive in order here to be as certain as possible of avoiding tilting movement thereof and thus jamming thereof, which can more easily occur if the roller rolls on a stationary element of the wedge drive and not on an element which also moves, such as the slider element in FIGS. 1 through 6. In principle however such an arrangement is possible, but the arrangement shown in FIGS. 1 through 6 is found to be more advantageous.

As can be seen in particular from FIG. 4, in its side surface the slider element is notched or provided with a groove or recess to be able to accommodate there the positive-action return device 60 with its first portion 61. That recess 23 is advantageously matched to the shape and size of the positive-action return device 60. That makes it possible to still further improve the hold to the slider element as it is possible to provide for a lateral hold for the clamp-like positive-action return device 60 within that recess 23. As can further be seen from FIG. 4 however a transverse wedge 80 is arranged within the notch, groove or recess. The transverse wedge 80 engages under the first portion 61 which protrudes directed towards the slider element and bears with that protruding portion over the transverse wedge 80. That can be seen from FIGS. 5 and 6. The transverse wedge 80 serves to permit adjustment of the positive-action return device to be able to compensate for tolerance differences which occur in manufacture. In that way the sliding play between the driver element and the positive-action return device can be set to 0.02 mm and less in order to ensure operationally reliable operability of the wedge drive.

Figure 8:
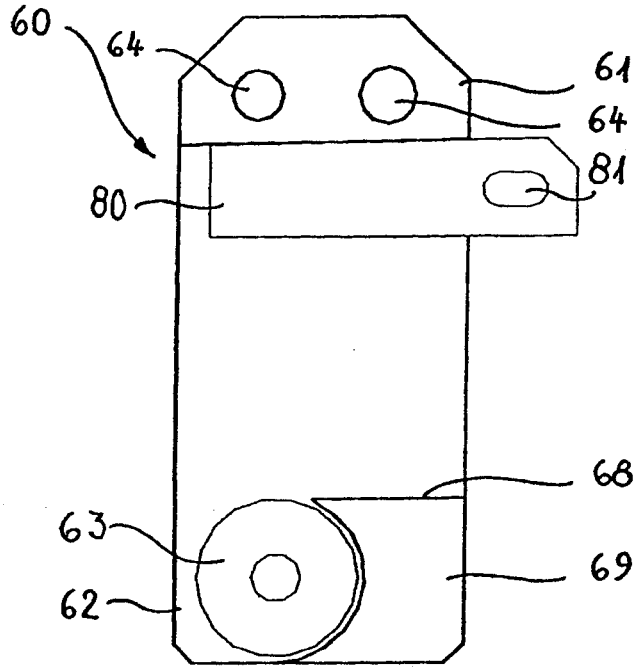
FIG. 8 shows a plan view of the positive-action return device of FIG. 1.
Figure 9:
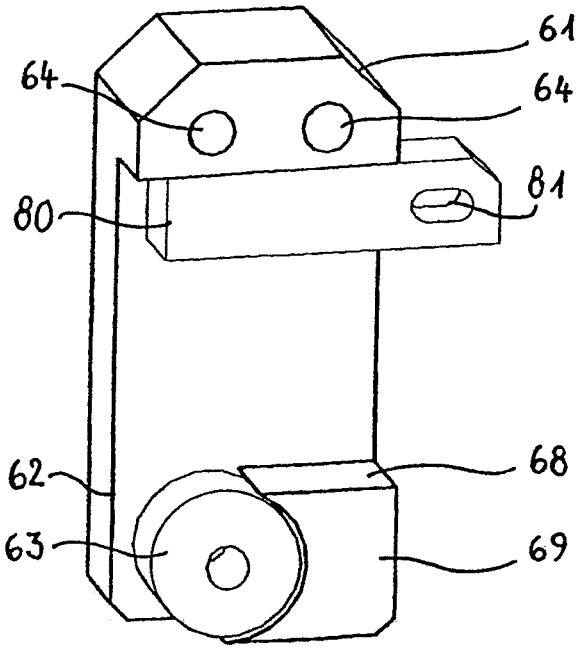
FIG. 9 shows a perspective view of the positive-action return device of FIG. 8.

The transverse wedge 80 is provided with a slot 81 and is fixed by way thereof to the slider element by way of a screw 82 or another fixing means. That permits transverse displacement of the transverse wedge 80 so that it is also possible to set the desired sliding clearance after fitment of the slider element. After adjustment of the positive-action return device it is fixed to the slider element, in the set position. That can be seen in particular also from the perspective view of the positive-action return device 60 and the plan view thereof in FIGS. 8 and 9. It is also possible to see in detail all portions and parts of the positive-action return device 60 from those Figures. In particular those Figures also show the configuration of the roller 63 and the sliding surface 68 on the protruding portion 69.

For reasons of symmetry and to permit the action of the positive-action return device 60 by virtue of uniform loading of the wedge drive on the left-hand and right-hand sides, two such positive-action return devices 60 are shown in FIGS. 1 through 6. In principle however it is also possible to provide more than two such positive-action return devices, for example two per side, if that should be necessary by virtue of the press forces to be transmitted and the wish for limiting the dimensions of the positive-action return device. In principle it is also possible to provide any other desired number of positive-action return devices in a wedge drive, in which respect, for cost reasons and reasons of simple and at the same time secure mounting and possibly also removal, the provision of only two positive-action return devices with a roller according to the invention or a roller-like element is usually sufficient.

With a sliding play between the driver element and the positive-action return device of 0.02 mm and less, it is possible to refer to the rearward press movement force being operationally reliably and securely carried. Ultimately that only leads to the production of the required retraction force of about 10% of the actual working force of the slider element. Conversely the positive-action return device is so designed that the force made available thereby constitutes about 10% of the pressing force of the slider element, which is the force required to pull a cutting means such as a perforating punch out of a workpiece, even having regard to possible deposits in the cutting gap, which further increase the difficulty in withdrawing the cutting means.

Besides the configurations, described hereinbefore and illustrated in the specific embodiment, of a wedge drive equipped with a positive-action return device according to the invention and having at least one roller or a roller-like element, numerous further variants are also possible, in which the at least positive-action return device is designed without a return spring, in particular a gas pressure spring. In order to provide the function thereof in terms of assisting with the return procedure in other ways and in order to be able to apply forces which as far as possible are greater than are possible with a gas pressure spring the positive-action return device has at least one other device minimizing the retraction forces to be applied, such as for example the above-mentioned rollers or roller-like elements for rolling against a surface of the one part of the wedge drive. If such rollers or roller-like elements are provided, they can in that case be suitably dimensioned and arranged on the positive-action return device to ensure reliable embracing clamping engagement of the mutually movable parts of the wedge drive in order to return the part of the wedge drive which moves in the working direction, reliably and in positively controlled fashion back into its starting position again. Alternatively to the provision of such roller or rollers or roller-like element or elements, it is also possible to provide other devices which, instead of a return spring, serve for assisting with the positive return action in respect of at least a part of the wedge drive or for increasing the retraction force which can be applied, and can be used for that purpose. Such a device can use for example a rolling friction which requires the application of a low force, instead of a sliding or static friction, in the retraction movement. In order to be able to set a small sliding play of 0.02 mm and less between the driver element and the positive-action return device, it is also possible, besides the provision of a transverse wedge, to provide another device for adjusting the positive-action return device for tolerance compensation, which can be provided on the positive-action return device itself and/or on the slider element or the driver element.

LIST OF REFERENCES

1 wedge drive
10 slider guide element
20 slider element
21 opening
22 opening
23 recess
30 driver element
31 outside surface
32 step-shaped cantilever projection
33 rounded end region
40 guide clamp
41 holding projection
42 holding projection
43 screw
50 prismatic guide
60 positive-action return device
61 first portion
62 second portion
63 roller
64 screw
65 spindle
66 outer edge
67 outer edge
68 sliding surface

69 protruding portion
70 arrow (working direction)
71 arrow (retraction direction)
72 center line
80 transverse wedge
81 slot
82 screw
V displacement
d roller diameter
b width of 60
r radius of 33

The invention claimed is:

1. A wedge drive comprising:

a slider configured to operably connect with a machining tool;

a driver operably connected to the slider, wherein the slider and the driver are arranged movably relative to each other to allow a working movement and a return movement of the slider;

a positive-action return engaging the slider and the driver, the positive-action return configured to apply a retraction force on the slider during the return movement of the slider;

an adjusting device comprising a transverse wedge configured to move relative to the positive-action return, the adjusting device configured to adjust the positive-action return for various tolerance compensations between the driver and the positive-action return; and a guide operably connected to the slider, the guide configured to perform a working stroke movement to cause the working movement of the slider and a return stroke movement to cause the return movement of the slider.

2. A wedge drive as set forth in claim 1, wherein the positive-action return comprises a roller or a roller-like element for rolling on a surface of the driver for supporting the return movement of the slider and for increasing the retraction force which can be applied in the return movement of the slider.

3. A wedge drive as set forth in claim 1, wherein the positive-action return is of a clamp-like configuration and is arranged on an outside of the wedge drive.

4. A wedge drive as set forth in claim 2, wherein the positive-action return comprises a first portion engaging the slider and a second portion including the roller or the roller-like element, the second portion engaging the surface of the driver.

5. A wedge drive as set forth in claim 4, wherein the first portion of the positive-action return is fixed to the slider, and wherein the second portion of the positive-action engages the driver in a force-locking relationship.

6. A wedge drive as set forth in claim 1, wherein the transverse wedge is linearly displaceable in a direction substantially parallel to a direction of the working movement and the return movement of the slider to adjust a sliding clearance between driver and the positive-action return.

7. A wedge drive as set forth in claim 4, wherein the transverse wedge is arranged between the first portion of the positive-action return and the slider, and wherein the transverse wedge is in direct contact with the first portion of the positive-action return and the slider.

8. A wedge drive as set forth in claim 1, wherein the adjusting device is fixed to the slider.

9. A wedge drive as set forth in claim 4, wherein the roller or the roller-like element is arranged asymmetrically on the positive-action return, including asymmetrically to the second portion.

10. A wedge drive as set forth in claim 2, wherein the roller or the roller-like element is configured to be displaced in a direction towards the working movement of the slider with respect to a central line of the positive-action return.

11. A wedge drive as set forth in claim 2, wherein the surface of the driver has a rounded end region to engage the positive-action return in the working movement of the slider.

12. A wedge drive as set forth in claim 11, wherein the roller or the roller-like element is of a diameter (d) corresponding at least to double a radius of the rounded end region.

13. A wedge drive as set forth in claim 2, wherein the roller or the roller-like element projects with its peripheral extent beyond an outer edge of the positive-action return.

14. A wedge drive as set forth in claim 1, wherein there is provided at least one device for sliding guidance for carrying relatively high forces.

15. A positive-action return for a wedge drive as set forth in claim 1, wherein the positive-action return is clamp-like.

16. A positive-action return as set forth in claim 2, wherein the roller or the roller-like element is arranged on the positive-action return eccentrically with respect thereto.

17. A positive-action return as set forth in claim 2, wherein the roller or the roller-like element is of a larger diameter (d) than would correspond to half a width (b) of the positive-action return.

18. A positive-action return as set forth in claim 2, wherein the roller or the roller-like element protrudes beyond an outer edge of the positive-action return.

19. A wedge drive as set forth in claim 1, wherein the positive-action return device is return spring-free and has at least one device for causing or supporting the return movement of the slider or for increasing the retraction force which can be applied in the return movement of the slider in the return stroke movement of the guide.

20. A wedge drive as set forth in claim 19, wherein the device for causing or supporting the return movement or increasing the retraction force which can be applied has a connection based on rolling friction between the slider and the driver.

21. A wedge drive as set forth in claim 6, wherein the transverse wedge comprises a slot configured to permit linear displacement of the transverse wedge in the direction substantially parallel to direction of the working movement and the return movement of the slider to adjust the sliding clearance between driver and the positive-action return.

22. A wedge drive as set forth in claim 7, wherein the transverse wedge is linearly displaceable in a direction substantially parallel to a direction of the working movement and the return movement of the slider, and wherein a surface of the transverse wedge contacting the first portion of the positive-action return is inclined relative to the parallel direction, and a surface of the first portion of the positive-action return contacting the transverse wedge is declined relative to the parallel direction such that linear displacement of the transverse wedge is configured to move the positive-action return in substantially a perpendicular direction relative to the parallel direction to adjust a sliding clearance between driver and the positive-action return.

* * * * *